United States Patent [19]

Schlage

[11] 3,967,846

[45] July 6, 1976

[54] LOCK

[75] Inventor: Ernest L. Schlage, Burlingame, Calif.

[73] Assignee: Schlage Lock Company, San Francisco, Calif.

[22] Filed: Apr. 8, 1974

[21] Appl. No.: 458,532

[52] U.S. Cl. ..... 292/359; 70/210; 70/283; 70/DIG. 3

[51] Int. Cl.[2] ..... E05B 13/00; E05B 13/10; E05B 47/04

[58] Field of Search ..... 70/146, 211, 283, 210; 292/359

[56] References Cited

UNITED STATES PATENTS

| | | | |
|---|---|---|---|
| 1,691,528 | 11/1928 | Schlage | 292/359 X |
| 1,956,388 | 4/1934 | Kalina | 292/359 X |
| 2,732,703 | 1/1956 | Noregaard | 70/211 |
| 2,834,194 | 5/1958 | Schlage et al. | 70/146 |
| 2,910,859 | 11/1959 | Allen et al. | 70/283 X |
| 3,456,974 | 7/1969 | Moore | 292/359 |

*Primary Examiner*—Paul R. Gilliam
*Assistant Examiner*—Carl F. Pietruszka
*Attorney, Agent, or Firm*—Lothrop & West

[57] ABSTRACT

A door lock has a frame in which a knob spindle is mounted for rotation about an axis. The spindle can be prevented from rotation on the frame by a bar movable along the axis into and out of a position in which the bar engages both the frame and a slot in the spindle. The bar is moved by a spring and by a manual button mounted in an inside knob on the frame. The spindle can also be prevented from rotation on the frame by a pin radially movable on the frame into and out of a position in which the pin engages both the frame and the spindle slot. The pin is moved by a spring and by an arcuate electromagnet disposed coaxially of the spindle and having a polepiece in position to influence an armature on the pin. The customary key-operated lock is installed in an outer knob fastened onto the spindle.

6 Claims, 3 Drawing Figures

LOCK

Locks, such as are usually installed on building and dwelling doors, normally include a lock bolt retractable by inner and outer knobs and under control of an outer key and an inner button. In the interest of increasing security there is often a need for a further locking mechanism which lends itself to separate and sometimes remote control. In addition, there are instances in which the lock bolt effectiveness is preferably controllable by means situated in the door lock mechanism mounted on the door panel, as distinguished from mechanism, such as a strike, located in the door jamb. While remote operation can be accomplished in a number of different fashions; for example, mechanically, it is often preferred to provide electrical operation in order that the control can easily be exercised from a far distant point, although electrical control can be installed quite close to or even with the lock unit itself. It is also desirable to provide an additional lock control cooperating with the controls normally embodied in a lock, and which can be utilized or not without greatly interfering with the customary range of lock functions, and which can be incorporated in a lock set of the sort ordinarily available, preferably without substantially altering the construction or assembly of the usual lock set.

It is therefore an object of the invention to provide a lock in which an additional control over and above those normally provided is available, and in which such control can be remotely situated.

Another object of the invention is to provide a lock of substantially standard construction with which there can easily be incorporated an additional control, preferably remote.

A further object of the invention is to provide a lock in which the customary lock functions can still be incorporated but with the further advantage of remote control.

A still further object of the invention is to provide a lock in which an extra control can be introduced without materially altering the already available lock mechanism.

Other objects of the invention, together with the foregoing, are attained in the form of lock described in the accompanying description and illustrated in the accompanying drawings, in which.

Figure 1:
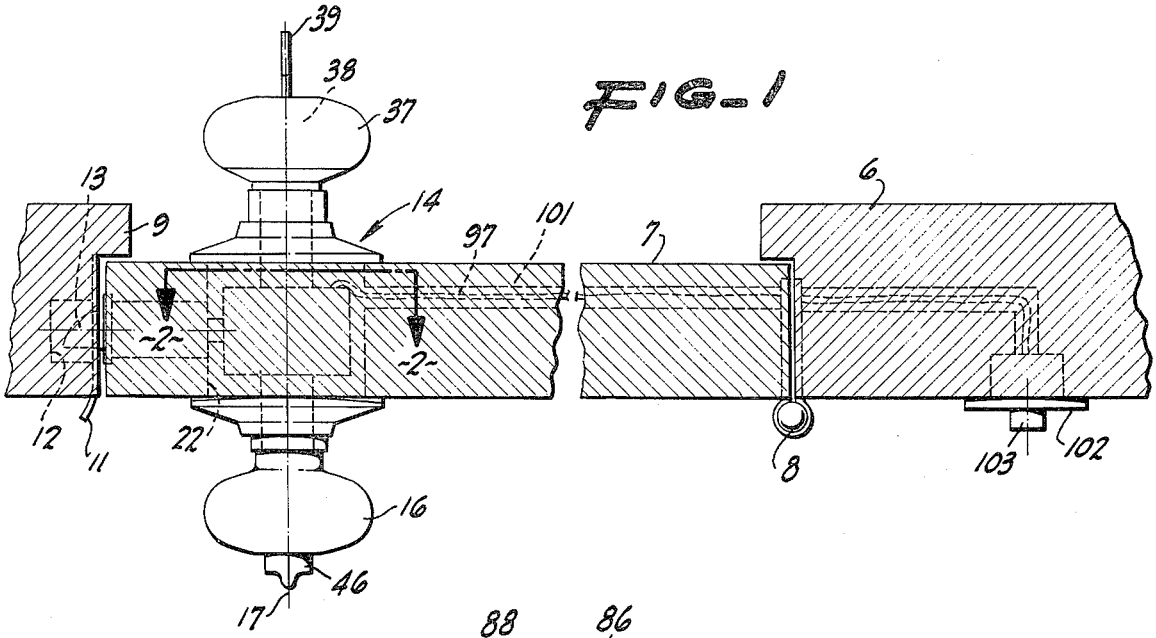
FIG. 1 is a cross-section on a horizontal plane looking down from above a lock set installed in the customary hinged door mounting.

The explanation herein is supplemented by reference to patents relating to lock sets of the general type described and shown in Walter R. Schlage U.S. Pat. No. 2,293,856 of August 25, 1942 and in Ernest L. Schlage et al. U.S. Pat. No. 2,834,194 of May 13, 1958 and embodied in numerous lock sets made by Schlage Lock Company, the assignee of those patents and of this patent application, and disclosed in Schlage Lock Company catalogs and publications on file in the Patent Office.

In a representative installation a building wall 6 is provided with a door opening in which is disposed a door panel 7 mounted on hinges 8 to swing into and out of the opening. The door when closed is in the position illustrated and lies against a stop 9 on the door frame. In the frame there is a strike plate 11 having a recess 12 to receive the spring-projected latch bolt 13 of a lock set, generally designated 14.

The hinge side of the door panel 7 for description herein is referred to as the inside or the secured side. On the hinge side of the panel the lock set 14 includes an inside knob 16 rotatable about a cross axis 17. The lock set is of any suitable construction, and in the present instance includes a frame 21 (FIG. 3) disposed inside of a cross bore 22 through the door panel. The frame is extended to provide an inner hub 23 concentric with the axis 17 and extending into the vicinity of the inner knob 16. The hub 23 houses an inner spindle 24 having a connection 26 to the knob 16 and to a rollback slide 27 for retracting the latch bolt 13 in the customary way when the knob 16 is rotated.

Also included in the frame 21 as a normally fastened but removable portion thereof is a wall 31 carrying a hub 32 concentric with the axis 17. The hub is preferably of circular, tubular form but has a pair of opposite indentations 33 (FIG. 2) which are restricted both axially and circumferentially. Rotatable within the outer hub 32 and also concentric with the axis 17 is an outer spindle 36 of generally tubular nature carrying an operating outer knob 37 releasably secured thereto. The outer knob 37 and the outer spindle 36 are thus fastened together for conjoint rotation and in a set axial position.

The outer knob 37 customarily houses a lock unit 38 (FIG. 1) into which the usual manually-operated key 39 can easily be introduced and withdrawn. The key mechanism is connected in the usual way to a latch bolt rollback structure. The outer spindle 36 is provided with a connection 41 to the rollback mechanism 27 so that it also can retract the latch bolt 13 against the normally provided spring 42. The outer spindle 36, at least, is preferably rolled up from sheet stock almost completely, but is left with the edges of the stock spaced apart to provide a slot 43 extending longitudinally of the spindle parallel to the axis 17.

In many installations, it is customary to provide a means for dogging or fixing the outer knob 37 so that it cannot be rotated with such dogging or fixing means being controlled from the interior side of the lock set. For that reason, the inner knob 16 serves as a housing for a spring-projected push button 46 movable axially. Sometimes the button is also rotatable. In a known fashion, the push button 46 is connected within the inner spindle 24 to a locking bar 47 much of which is coincident with and extends along the axis 17 from a location adjacent the inner knob 16 to a location within the frame 21. The bar 47 is connected through a spacer 48 and a guide 49 to a return spring 50 so that normally the bar 47 and the button 46 are in an extended or unlocked condition. In all positions of the bar, an offset portion 51 of the bar is lodged in a radial notch 52 in a frame plate 53, as well as in a notch 54 in the plate 31.

When the button 46 is depressed, the bar 47 is translated along the axis, and the extension 51 thereof not only slides within the notches 52 and 54, but likewise advances axially far enough to enter into the end of the slot 43 in the outer spindle 36. In this position the bar 47 acts as a dog and is effective to dog or hold the spindle 36 against rotation, since the spindle is temporarily locked to the frame. Consequently, the outer knob 37 is not rotatable. Anyone attempting to open the door by rotating the outer knob 37 when it is thus locked from the interior is prevented from doing so.

Under most locking or keying arrangements, a person at any time putting a proper key 39 into the lock unit 38 is able, independently of the immobility of the outer spindle 36 and of the outer knob 37, to actuate the slide 27 by well-known means and retract the bolt 13 so as to enter. Whenever the thumb button 46 is projected and is not in locked position, the offset portion 51 of the bar 47 is withdrawn to the position shown in FIG. 3 free of the slot 43 in the outer spindle. Under those circumstances and with the mechanism so far described, the outer knob 37 can be freely rotated and carry the outer spindle 36 with it to retract the latch bolt.

Particularly in accordance with this invention there is provided an additional locking means for the outer spindle and knob 37 and preferably a locking means which can be remotely actuated, and preferably by electricity.

In most lock arrangements the frame 21 is generally circular in outline in a plane normal to the axis 17, and the plates 31 and 53 are customarily set in or spaced from the end of the frame 21 to leave a generally annular compartment 61 coaxial with and surrounding the hub 32. The thickness of the door panel 7 is most often such that there is substantial axial space between the ends of the frame 21 and the door panel faces. I consequently utilize the compartment 61 and some of the adjacent space to contain additional locking mechanism and preferably do so without altering the lock set already provided.

Figure 2:
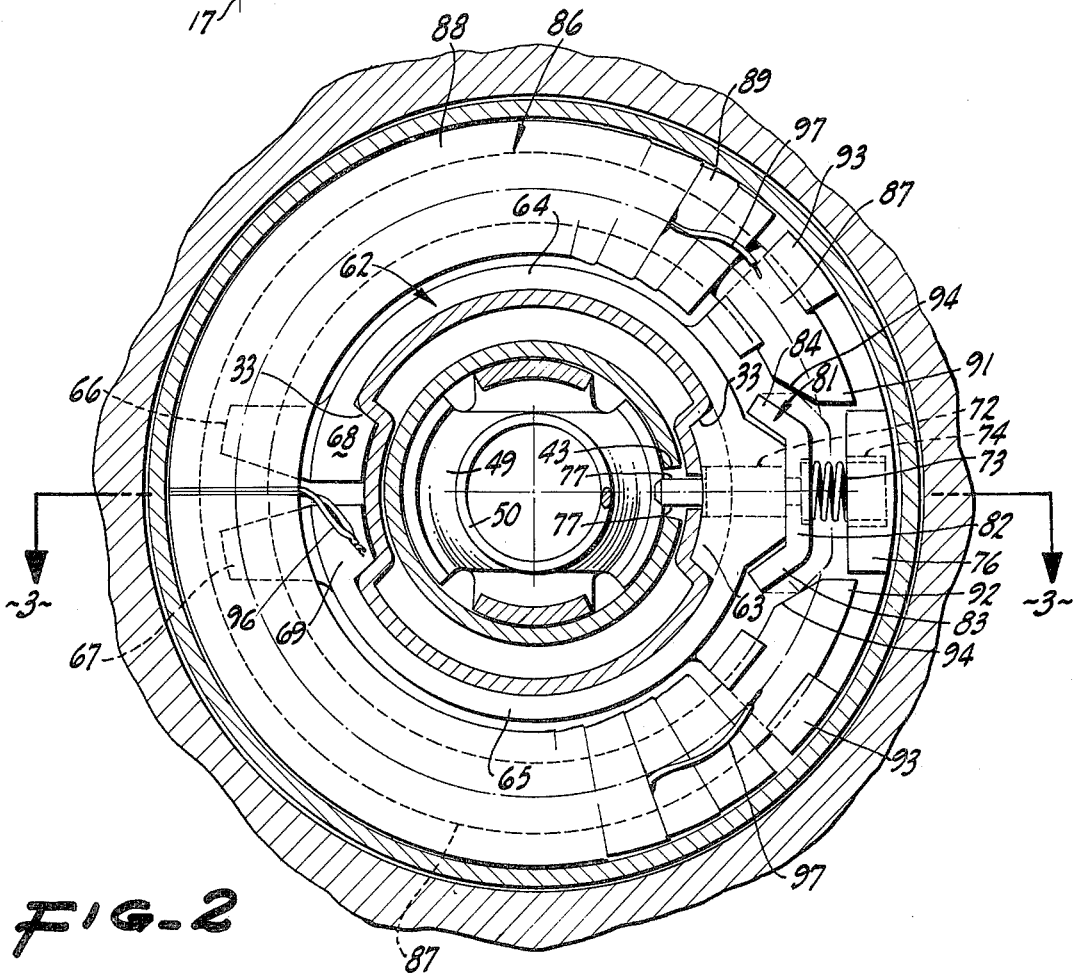
FIG. 2 is a cross-section to a greatly enlarged scale, the plane of section being indicated by the line 2-2 of FIG. 1.
Figure 3:
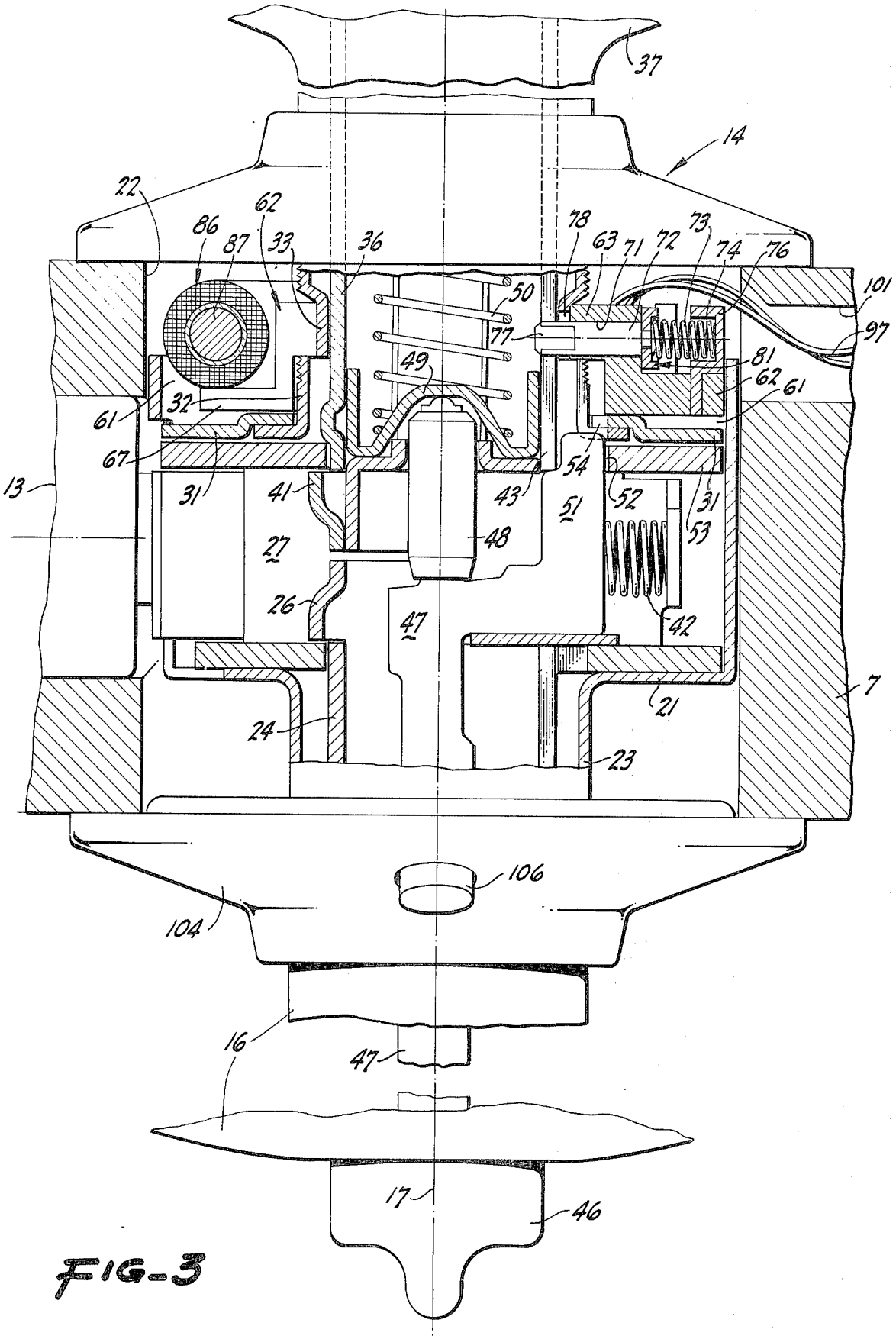
FIG. 3 is a view to the same scale as FIG. 2 and showing in cross-section and in reverse aspect the structure shown in FIG. 2, the plane of section being indicated by the line 3-3 of FIG. 2.

Designed to be largely located in the open-ended compartment 61 is an annular support 62 or mounting especially as shown in FIGS. 2 and 3. This is a resilient, chip-like mechanism including a single lug 63 centrally located between a pair of arcuate side arms 64 and 65 extending around the larger portions of the hub 32 and terminating in radial tabs 66 and 67. These are normally slightly spaced apart but are urged toward each other by the resiliency of the support. The tabs 66 and 67 include radially disposed lugs 68 and 69 designed to lie within the other of the opposite indentations 33 in the hub 32. When the side arms 64 and 65 are deformed and widely spread apart, the support 62 can be slipped over the hub 32 and moved axially until such time as the lugs 63, 68 and 69 spring into the customarily provided pair of indentations 33. The support grips firmly around the outside of the hub, and the lugs in engagement with the indentations prevent the mounting from rotating about the axis and from moving along the axis.

The mounting 62 carries a radial bore 71 (FIG. 3) in which is disposed a pin 72 having sufficient clearance for free radial movement. The pin at one end abuts a spring 73 also lodged in a pocket 74 in a bracket 76 mounted in a portion of the support 62. The bracket 76 is removable from the support so that the pin 72 and the spring 73 can easily be installed and removed. The spring urges the pin 72 in a radially inward direction. The pin 72 at its inner end is preferably formed with a pair of flats 77 in order freely to enter into the slot 43 in the spindle after passing through a similar opening 78 normally existing in the hub 32. When the pin 72 is projected, as illustrated in FIG. 3, it interengages the hub 32 fast on the frame 21 and the spindle 36, and so locks the outer knob 37 against rotation about the axis 17 and thus prevents the outer knob from retracting the latch bolt. This is similar to the operation of the bar 47. The same slot 43 in the outer spindle is utilized, the direction of operation of the pin 72 being radial and the direction of operation of the bar 47 being axial.

Means are provided for withdrawing or removing the pin 72 from the slot 43 and thus freeing the outer spindle 36 for rotation unless it is otherwise restrained. To that end, the pin 72 is capped with an armature 81 fixed on the pin and in part interposed between the pin and the spring and extending in an approximately circumferential direction and partly within the compartment 61. The armature is formed with a generally tangent central portion 82 (FIG. 2) and a pair of inwardly deflected arms 83 and 84.

Designed to cooperate with the armature, and effective when energized to move the armature radially, is an electromagnet 86. This is a generally arcuate or circular mechanism. For convenience, the electromagnet has a curved core 87 (FIG. 2) surrounded by two helical half-winding coils 88 and an insulating wrapping 89. The coils are virtually in abutment at one side of the axis, but at the other side are spaced substantially apart to expose a pair of angled pole-pieces 91 and 92. These are symmetrical and are clamped between gripping members 93 on the mounting 62.

The pole-pieces are especially contoured to afford faces 94 approximately parallel to and opposite the inturned arms 83 and 84 of the armature.

The coils 88 are connected together by leads 96 and also have end leads 97 which, as shown in FIG. 3, are carried out through the cross bore 22 into a bore 101 in the door panel. The leads 97 extend, as shown in FIG. 1, through an appropriate connection to a stationary wall switch 102, preferably on the inside of the room, and having access to a source of power. A push button 103 is effective when depressed to energize the solenoid coil, and when released to de-energize such coil. The push button or other switch can be oppositely effective.

When de-energized, the coil has no effect on the pole-pieces and so none upon the armature 81. The spring 73 keeps the pin 72 in place, and the outer knob is locked by the pin against rotation. When the button 103 is depressed and the coils are energized, then the pole-pieces draw the armature radially outward, retracting the pin from the slot 43 and permitting the outer knob, if otherwise free, to be rotated to retract the latch bolt 13.

As to general operation of this mechanism, it can, of course, be left entirely open and unlocked for retraction of the latch bolt by either knob without difficulty. The device even if locked can be unlocked to withdraw the latch bolt by using a proper outside key at any time. If the device is remotely locked, as shown in FIGS. 2 and 3, then it can easily be unlocked by depression of the remote button 103. But if the inner button 46 is depressed, the bar 47 lies in the slot 43, so even if the button 103 is actuated and withdraws the pin 72, the spindle 36 is still prevented by the bar 47 from rotating. In such a case outside entry can be gained only by the key.

While the button 103 is shown quite close to the inner knob 16, there are installations in which the button 103 can be put at a quite remote point, so that unless the outer knob is locked by reason of depression of the inner button 46, access can be afforded from the outside by remote depression of the button 103. A typical installation is one in which nothing need be done to the wall or frame around the door panel, and the entire extra locking mechanism, except for a remote control, is built into and forms part of a standard lock set without in any wise interfering with any of the standard mechanism or standard functions accomplished thereby.

The control mechanism and the pin 72 can easily be removed at any time simply by removing the lead wires and by manually spreading the tabs 66 and 67 and slipping the mounting and its attendant coil and pin arrangement out of the compartment 61, thus restoring the lock set to its original condition. The switch 102 need not be remote but can easily be mounted on or duplicated by a switch on the regular lock set; for example, on a specially adapted inner escutcheon 104 (FIG. 3) for actuation by a button 106, the leads and power source being appropriately arranged.

What is claimed is:

1. A lock having a frame, a knob spindle mounted on said frame for rotation about an axis, means for preventing said rotation of said spindle including a pin movable on said frame in a direction radial to said axis between a first position holding said spindle against rotation relative to said frame and a second position freeing said spindle from said frame, a spring urging said pin toward one of said positions, an electromagnet substantially arcuate in shape and having a pole positioned to urge said pin against said spring and for urging said pin toward the other of said positions, and means mounting said electromagnet on said frame coaxially around said spindle.

2. A lock as in claim 1 in which said frame includes a hub coaxially surrounding said spindle and said mounting means surrounds and engages said hub.

3. A lock as in claim 2 including means for holding said mounting means and said hub against relative rotation.

4. A lock as in claim 1 including a coaxial hub on said frame and having an axially and radially limited depression therein, an arcuate mounting means of resilient material adapted to surround said hub and having a lug resiliently movable into and out of said depression, and means on said mounting for supporting said pin for radial movement.

5. A lock as in claim 4 including means on said mounting for supporting said spring in abutment with said pin.

6. A lock having a frame, a knob spindle mounted on said frame for rotation about an axis, a pin, means on said frame for mounting said pin for radial movement thereon between a first position in engagement with said spindle and holding the same against rotation on said frame and a second position free of said spindle, an armature on said pin, an arcuate electromagnet, means mounting said electromagnet coaxially on said frame, and a pole-piece on said electromagnet in position to influence said armature.

* * * * *